US007465009B2

(12) United States Patent
Fujita

(10) Patent No.: US 7,465,009 B2
(45) Date of Patent: Dec. 16, 2008

(54) PRINTING APPARATUS, PRINTING SYSTEM, AND PRINTING START POSITION ALIGNMENT METHOD

(75) Inventor: Yoshifumi Fujita, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 167 days.

(21) Appl. No.: 11/088,801

(22) Filed: Mar. 25, 2005

(65) Prior Publication Data

US 2005/0219300 A1 Oct. 6, 2005

(30) Foreign Application Priority Data

Mar. 31, 2004 (JP) ..... 2004-106362

(51) Int. Cl.
*B41J 29/38* (2006.01)

(52) U.S. Cl. ..... 347/16

(58) Field of Classification Search ..... 347/16, 347/5, 14, 19, 37

See application file for complete search history.

(56) References Cited

U.S. PATENT DOCUMENTS

| | | | | |
|---|---|---|---|---|
| 5,050,100 | A * | 9/1991 | Damon et al. | 358/1.16 |
| 6,058,222 | A * | 5/2000 | Hashimoto | 382/300 |
| 6,543,892 | B2 | 4/2003 | Kubota et al. | 347/109 |
| 6,585,353 | B1 * | 7/2003 | Kanematsu et al. | 347/43 |
| 6,834,929 | B1 * | 12/2004 | Adams et al. | 347/19 |
| 6,866,358 | B2 | 3/2005 | Masuyama et al. | 347/14 |
| 6,874,957 | B2 * | 4/2005 | Fujita | 400/62 |
| 6,917,434 | B1 | 7/2005 | Ohta | 358/1.13 |
| 7,207,639 | B2 * | 4/2007 | Kachi | 347/14 |
| 2002/0036665 | A1 * | 3/2002 | Shima | 347/5 |
| 2003/0035021 | A1 | 2/2003 | Masuyama et al. | 347/40 |
| 2004/0041861 | A1 * | 3/2004 | Maeda | 347/9 |
| 2004/0246285 | A1 * | 12/2004 | Endo | 347/14 |
| 2006/0066700 | A1 * | 3/2006 | Simpson | 347/101 |

FOREIGN PATENT DOCUMENTS

| | | | |
|---|---|---|---|
| EP | 959404 | A2 * | 11/1999 |
| EP | 1 285 767 | A1 | 2/2003 |
| JP | 2000-99295 | | 4/2000 |
| JP | 2003-127341 | | 5/2003 |

* cited by examiner

*Primary Examiner*—Hai C Pham
(74) *Attorney, Agent, or Firm*—Fitzpatrick, Cella, Harper & Scinto

(57) ABSTRACT

In a printing apparatus which prints by serial scanning, a control command and image data formed from a plurality of rasters as a unit that are received from a connected host apparatus are stored in a reception buffer. Whether to perform marginless printing of printing on the entire surface of a printing medium is determined on the basis of information on the size of image data and information on the size of the printing medium that are contained in the control command. When marginless printing is performed, the amount of unnecessary image data is calculated by using a plurality of rasters as a unit on the basis of the length of the printing medium in the conveyance direction and the length of the image data in the conveyance direction. The printing start position of the printing medium in the conveyance direction is aligned by a distance corresponding to the number of rasters as a remainder of the calculation. Accordingly, the start position of marginless printing on the printing medium in the conveyance direction can be accurately controlled when marginless printing is executed.

7 Claims, 14 Drawing Sheets

PRINTING APPARATUS, PRINTING SYSTEM, AND PRINTING START POSITION ALIGNMENT METHOD

FIELD OF THE INVENTION

The present invention relates to a printing apparatus, printing system, and printing start position alignment method and, more particularly, to alignment of a printing start position in performing "marginless printing" on the entire surface of a printing medium by a printing apparatus which prints by scanning, on a printing medium in a direction crossing the array direction of printing elements, a carriage supporting a printhead having the printing elements arrayed in a predetermined direction.

BACKGROUND OF THE INVENTION

A printer which prints information such as a desired character or image on a sheet-like printing medium such as a paper sheet or film is widely used as an information output apparatus for a wordprocessor, personal computer, facsimile apparatus, and the like.

Various methods are known as printing methods for the printer. Especially an inkjet method has recently received a great deal of attention because this method can realize non-contact printing on a printing medium such as a paper sheet, easily prints in color, and is quiet. Because of low cost and easy downsizing, a popular inkjet arrangement is a serial printing system in which a printhead for discharging ink in accordance with desired printing information is mounted and prints while reciprocally scanning in a direction crossing the conveyance direction of a printing medium such as a paper sheet.

Recently, inkjet printers capable of so-called "marginless printing" (also referred to as "borderless printing" or "full-page printing") are increasing in which printing is done on the entire surface of a printing medium (printing is done without any margin at the edge of a printing medium).

To realize marginless printing, printing data having a printing region larger than a printing medium used for printing is generated, and ink at a portion protruding from the printing medium is discharged onto a platen or an ink absorber arranged below (e.g., U.S. AA2003 035021 or EP A1 1285767 both of which correspond to Japanese Patent Laid-Open No. 2003-127341).

In order to shorten the data transfer time from the host apparatus and increase the printing speed in this type of printing apparatus, image data of each raster block including a plurality of rasters is generated by a printer driver installed in a host apparatus, and transferred to the printing apparatus. The printing apparatus rasterizes the received image data of each raster block in a buffer to convert the data into printing data (e.g., EP A3 959404, which corresponds to Japanese Patent Laid-Open No. 2000-099295).

However, the following problem is caused by marginless printing executed in the printing apparatus which receives image data of each raster block from the host apparatus.

FIG. 11 is a view showing an example of the relationship between the size of a printing medium, a target printing area, and the size of image data. In FIG. 11, reference numeral 111 denotes a printing medium; 112, a target printing area by the printing apparatus; and 113, image data. FIG. 11 illustrates the printing medium 111, target printing area 112, and image data 113 in overlapping manner with each other. As shown in FIG. 11, the image data 113 has a width dw in the scanning direction (x direction) and a length dh in the conveyance direction (y direction). The target printing area 112 has a width aw in the scanning direction (x direction) and a length ah in the conveyance direction (y direction). The printing medium 111 has a width pw in the scanning direction (x direction) and a length ph in the conveyance direction (y direction). These dimensions satisfy pw<aw<dw and ph<ah<dh. A comparison in area is 111<112<113. In the example shown in FIG. 11, the centers of the printing medium 111, target printing area 112, and image data 113 are adjusted.

Printing is done on the entire surface of such a printing medium, and printing without any margin is expressed as marginless printing. In addition to this case, marginless printing can also be applied to printing in which a small margin is left at the edge of a printing medium and printing in which no margin is set at only a predetermined edge of a printing medium. For example, marginless printing can also be applied to printing in which no margin is set at the left edge, right edge, and trailing edge (upstream side in the paper feed direction) of a printing medium. In performing the marginless printing, image data which falls outside the area of the printing medium 111 and is not printed on the printing medium is unnecessary, and must be rejected (removed) after reception.

When, however, image data is transferred for each block of rasters, as described above, the image data is also rejected or removed for each raster block. Hence, excess raster data remains unless ½ of the difference between a height (length in the paper feed direction) dh of image data and a height (length in the paper feed direction) ph of the printing medium is a multiple of the height of the raster block. Printing starts from a position deviated by excess rasters, and the start position of marginless printing in the paper feed direction shifts from a position intended by the user.

SUMMARY OF THE INVENTION

It is an object of the present invention to provide a printing apparatus which receives image data of each raster block and can accurately control the start position of marginless printing in the paper feed direction.

It is another object of the present invention to provide a printing system capable of accurately controlling the start position of marginless printing in the paper feed direction in an arrangement in which image data of each raster block is transmitted/received.

It is still another object of the present invention to provide a printing method capable of accurately controlling the start position of marginless printing in the paper feed direction in a printing apparatus which receives image data of each raster block.

To achieve the above objects, a printing apparatus according to one aspect of the present invention there is provided a printing apparatus which prints by scanning, on a printing medium in a direction crossing an array direction of printing elements, a carriage supporting a printhead having the printing elements arrayed in a predetermined direction, comprising: a reception buffer which stores a control command and image data formed from a plurality of rasters as a unit that are received from a connected host apparatus; determination means for determining, on the basis of information on a size of image data and information on a size of a printing medium that are contained in the control command, whether to perform marginless printing, which performs printing on an entire surface of the printing medium; calculation means for calculating an amount of image data not used for printing by using the plurality of rasters as a unit on the basis of a length of the printing medium in a conveyance direction and a length of the image data in the conveyance direction when marginless printing is performed; and alignment means for aligning a printing start position of the printing medium in the conveyance direction in correspondence with the number of rasters as a remainder of the calculation.

More specifically, according to the present invention, in a printing apparatus which prints by scanning, on a printing medium in a direction crossing the array direction of printing elements, a carriage supporting a printhead having the printing elements arrayed in a predetermined direction, a control command and image data formed from a plurality of rasters as a unit that are received from a connected host apparatus are stored in a reception buffer. Whether to perform marginless printing of printing on the entire surface of a printing medium is determined on the basis of information on the size of image data and information on the size of the printing medium that are contained in the control command. When marginless printing is performed, the amount of unnecessary image data is calculated by using a plurality of rasters as a unit on the basis of the length of the printing medium in the conveyance direction and the length of the image data in the conveyance direction. The printing start position of the printing medium in the conveyance direction is aligned by a distance corresponding to the number of rasters as a remainder of the calculation.

With this arrangement, when marginless printing of printing on the entire surface of a printing medium is executed in the printing apparatus which receives image data from a host apparatus by using a plurality of rasters as a unit, the amount of image data protruding from the length of a printing medium in the conveyance direction is calculated as a multiple of the rasters serving as a unit. The calculated amount of image data is rejected (removed) without being used for printing data, and the printing start position of the printing medium in the conveyance direction is aligned by a distance corresponding to the number of rasters as a remainder.

In the printing apparatus which receives image data by using a plurality of rasters as a unit, the start position of marginless printing on a printing medium in the conveyance direction can be accurately controlled.

When the size of the image data is larger than a target printing area of the printing apparatus, the calculation means may calculate an amount of unnecessary image data by using the plurality of rasters as a unit on the basis of the length of the printing medium in the conveyance direction and a length of the target printing area in the conveyance direction.

The apparatus may further comprise conversion means for converting the image data into a format corresponding to scanning of the printhead, and data rejection means for rejecting, from data to be converted by the conversion means, the unnecessary image data formed from the plurality of rasters as a unit that is calculated by the calculation means.

The printhead may include an inkjet printhead which prints by discharging ink.

According to another aspect of the invention, the above object is attained by a printing apparatus which has a buffer for storing a control command and image data formed from a plurality of rasters as a unit, which are externally input, and prints by using a printhead, comprising: calculation means for calculating a data amount not used for printing by using the plurality of rasters as a unit on the basis of length information of a printing medium in a conveyance direction and length information of the image data in the conveyance direction that is contained in the control command when printing is performed on the printing medium; rejection means for performing a rejection process of image data on a downstream side in the conveyance direction from the externally input image data on the basis of the data amount calculated by the calculation means; and control means for printing on and outside the printing medium by using image data having undergone the rejection process by the rejection means.

The above objects can also be achieved by a printing start position alignment method for a printing apparatus that corresponds to the above printing apparatus, a computer program which causes a computer apparatus to execute the printing start position alignment method, and a storage medium which stores the computer program.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENT

Preferred embodiments of the present invention will now be described in detail in accordance with the accompanying drawings.

In this specification, "print" is not only to form significant information such as characters and graphics, but also to form, e.g., images, figures, and patterns on printing media in a broad sense, regardless of whether the information formed is significant or insignificant or whether the information formed is visualized so that a human can visually perceive it, or to process printing media.

"Print media" are any media capable of receiving ink, such as cloth, plastic films, metal plates, glass, ceramics, wood, and leather, as well as paper sheets used in common printing apparatuses.

Further, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

Moreover, "printing element" should be interpreted as any combination of a discharge opening (nozzle), a channel communicating thereto and an energy-generating element used for discharging ink, without annotation.

Figure 1:
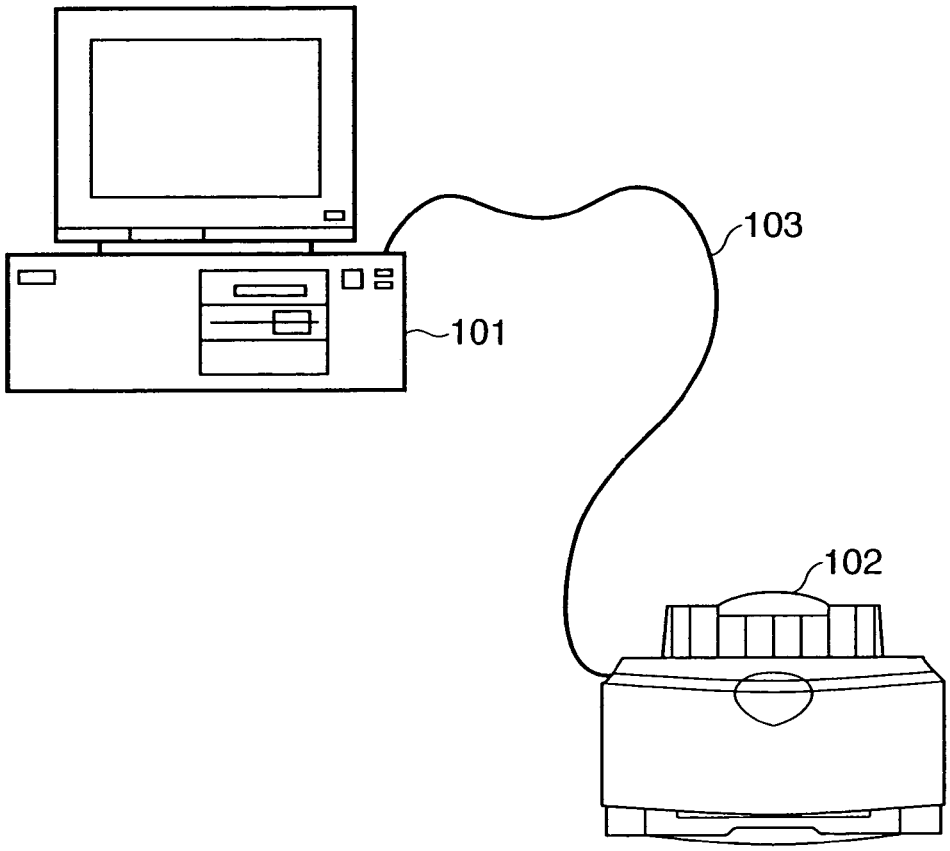
FIG. 1 is a view showing a printing system according to an embodiment of the present invention.

FIG. 1 shows a printing system according to an embodiment of the present invention. In FIG. 1, reference numeral 101 denotes a personal computer (to be also simply referred to as a PC hereinafter) serving as a host apparatus; 102, an inkjet printer (to be also simply referred to as a printer hereinafter) serving as a printing apparatus; and 103, a cable which connects the host apparatus and printer.

A printer driver for the printer 102 is installed in the PC 101. For example, when printing is instructed during execution of an application, the printer driver is activated to generate image data on the basis of information designated by the user, and image data of each raster block formed from a plurality of rasters is transferred to the printer 102 via the cable 103 together with a control command.

Upon reception of the control command and image data of each raster block, the printer 102 analyzes the control command, converts the raster block data into printing data corresponding to one scanning of the printhead, and executes printing.

Figure 14:
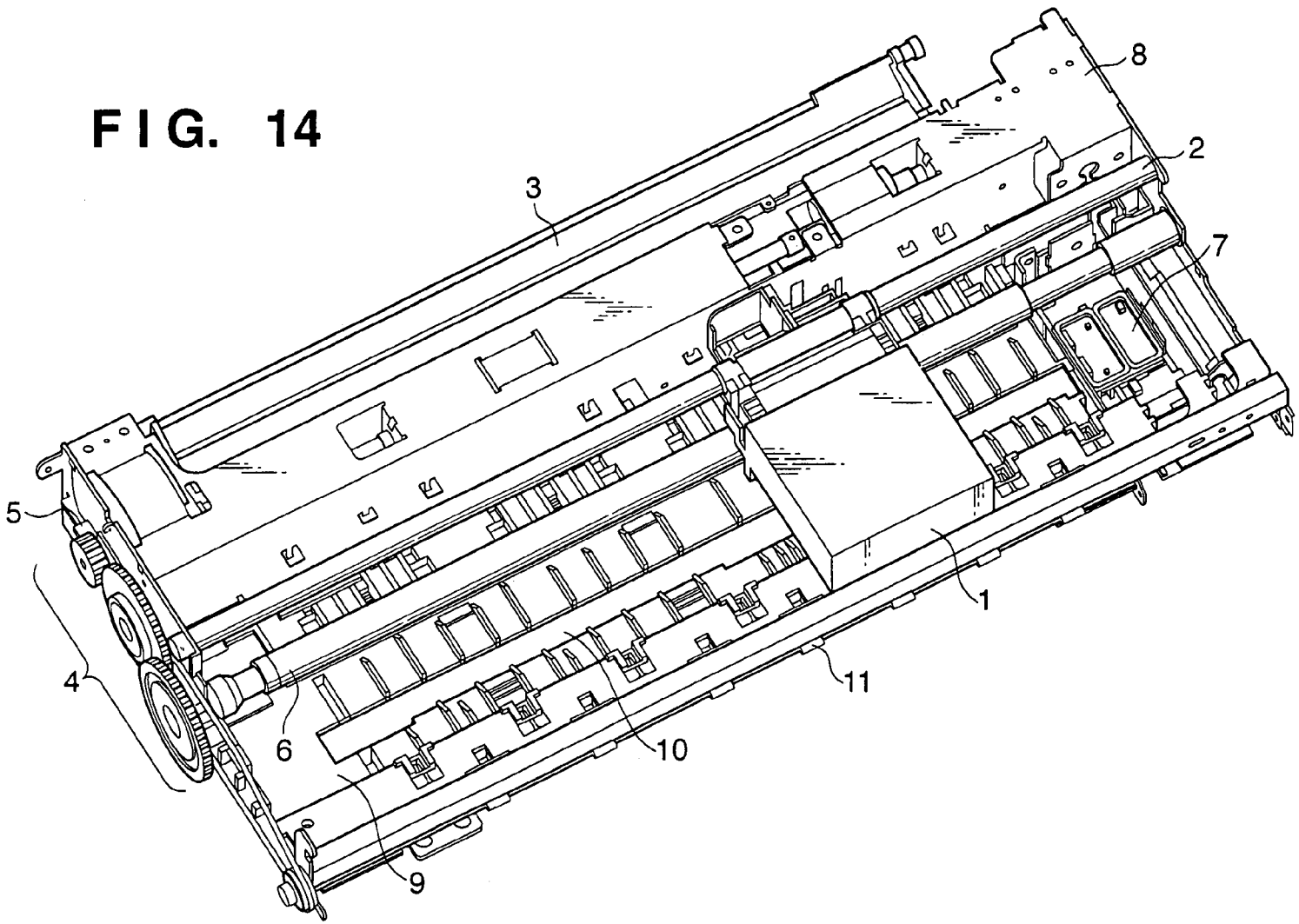
FIG. 14 is a perspective view showing the structure of the printing apparatus.

FIG. 14 is a perspective view showing the printer 102 described in the embodiment. Reference numeral 3 denotes an ASF (automatic sheet feeder), which feeds a plurality of stacked printing media to a printing portion one by one. A printing medium fed by the ASF 3 is conveyed to the printing portion by an LF roller 6 and a pinch roller (not shown).

The LF roller 6 receives the driving force of an LF motor 5 via an LF gear 4, and conveys the printing medium in the sub-scanning direction in which the LF roller 6 is intermittently driven on the basis of a printing instruction.

A platen 9 is arranged to convey a printing medium. A carriage 1 which supports an inkjet printhead is arranged at a portion facing the platen 9, and equipped with an ink tank which stores ink and supplies it to the inkjet printhead.

The carriage 1 is guided along a guide shaft 2, driven via a timing belt (not shown) upon driving of a carriage motor (not shown), and scans the printhead in the main scanning direction on the basis of a printing instruction. Sub-scanning by the LF roller 6 and main scanning by the carriage 1 are alternately repeated to form an image on a printing medium, which is so-called serial printing operation. A printed medium is discharged outside the printing apparatus by a delivery roller 11.

A platen opening 10 is formed in the platen 9, and a platen absorber 12 (not shown) is arranged immediately below the platen opening 10.

Figure 2:
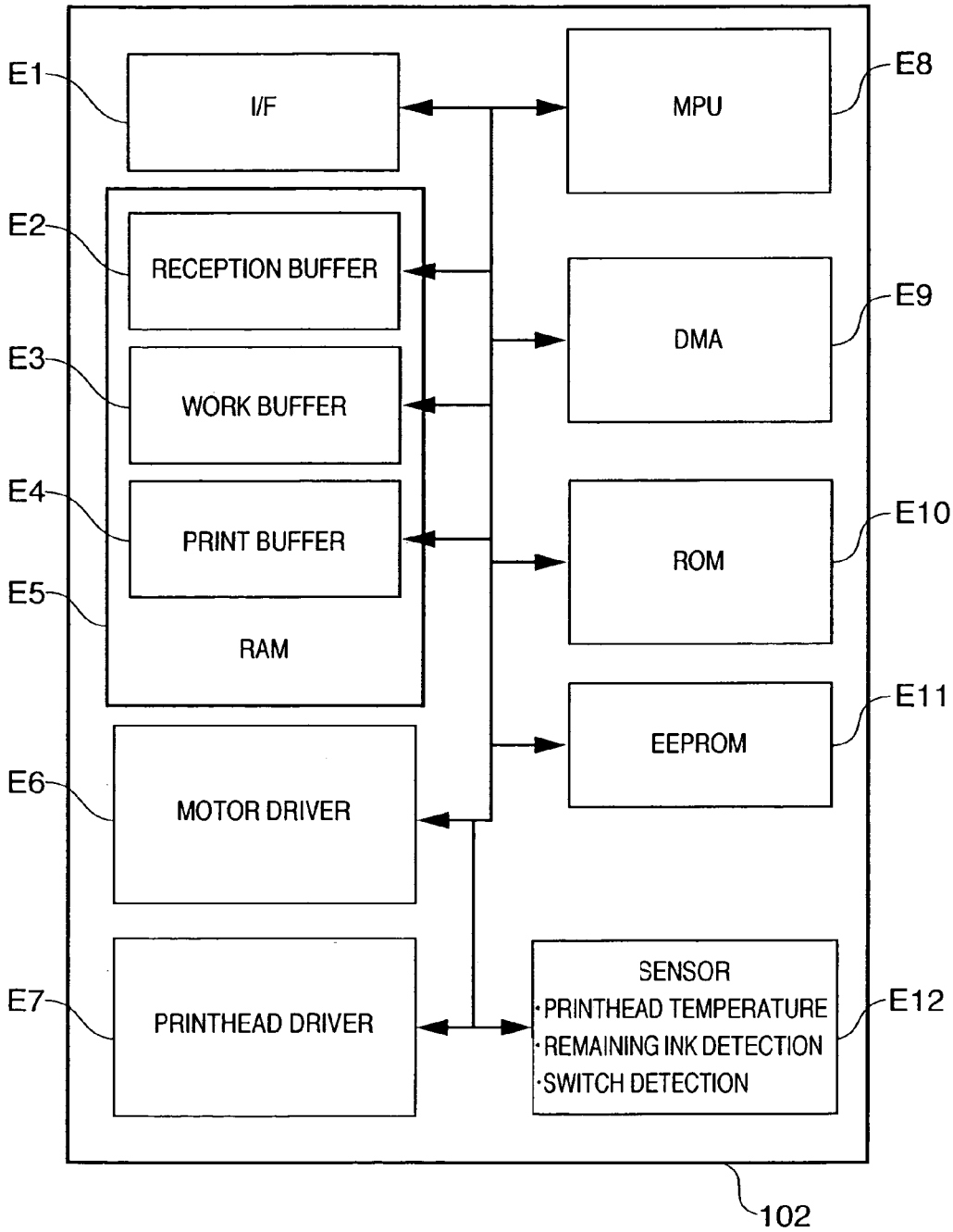
FIG. 2 is a block diagram showing the control configuration of a printing apparatus in FIG. 1.

FIG. 2 is a block diagram showing the control configuration of the printer 102.

As shown in FIG. 2, the printer 102 comprises an interface (I/F) section E1 which controls reception of commands and image data transmitted from a host apparatus and communication of various control signals, a RAM E5, a motor driver E6 which controls a carriage motor for driving a carriage, a conveyance motor for conveying a printing medium, and the like, a printhead driver E7 which drives the printhead in accordance with printing data, an MPU E8 which controls the whole apparatus, a DMA section E9 which directly accesses the RAM and ROM to transfer data, a ROM E10 which stores a program corresponding to a control sequence, a predetermined table, and other permanent data, an EEPROM E11 which stores various types of information and data in an electrically rewritable manner, and a sensor E12 which includes various sensors and operation switches for the printhead temperature, remaining ink detection, and the like. These units are connected to each other via a system bus.

The RAM E5 incorporates a reception buffer E2 which temporarily stores received commands and image data, a work buffer E3 which is used as an image data rasterizing area and a work area for executing a program, and a print buffer E4 which stores printing data of a format corresponding to scanning of the printhead.

Figure 11:
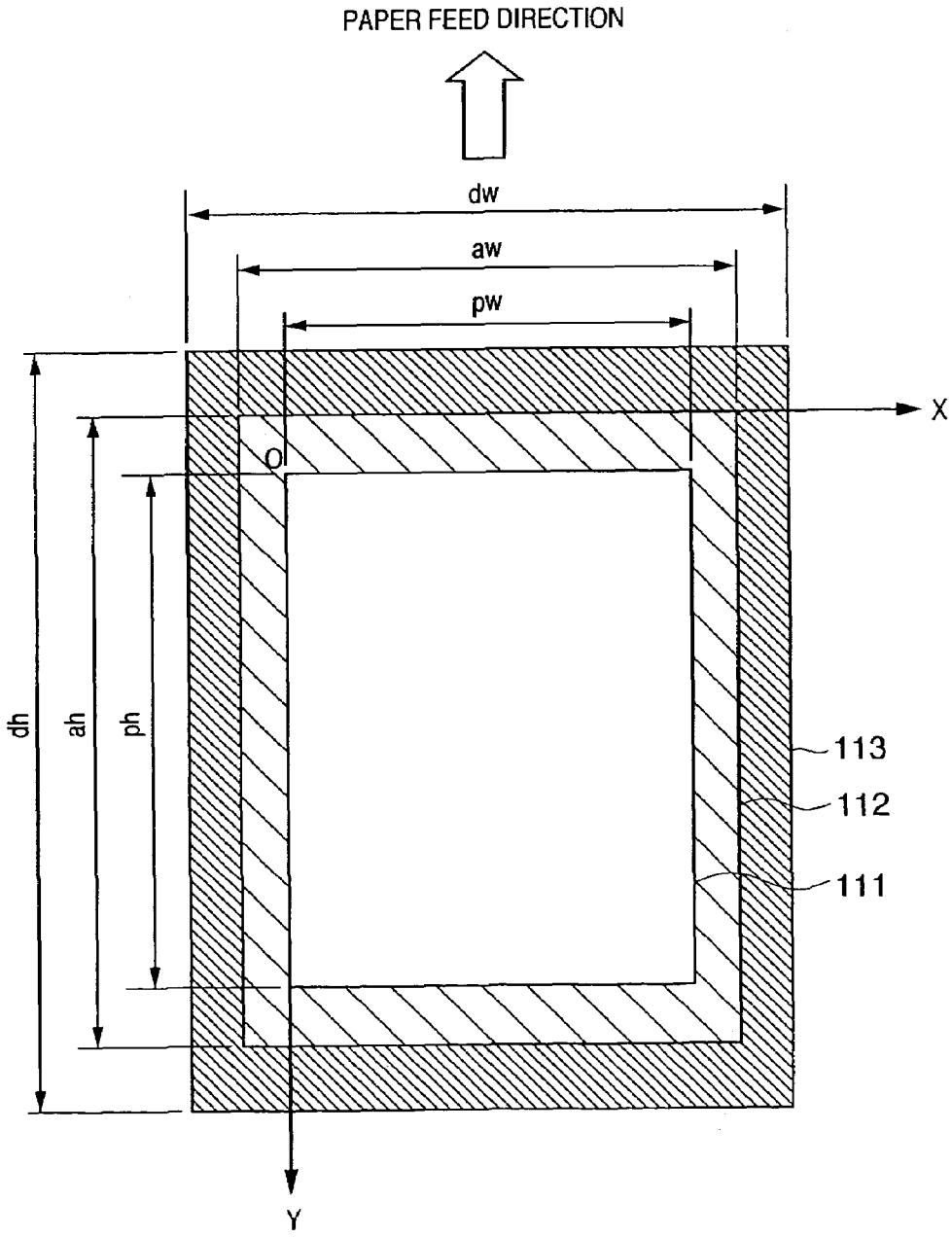
FIG. 11 is a view showing an example of the relationship between the size of a printing medium, a target printing area, and the size of image data.

A data processing in marginless printing according to the embodiment will be explained. Note that the relationship between the size of a printing medium, a target printing area, and the size of image data is the same as that shown in FIG. 11.

Figure 3:
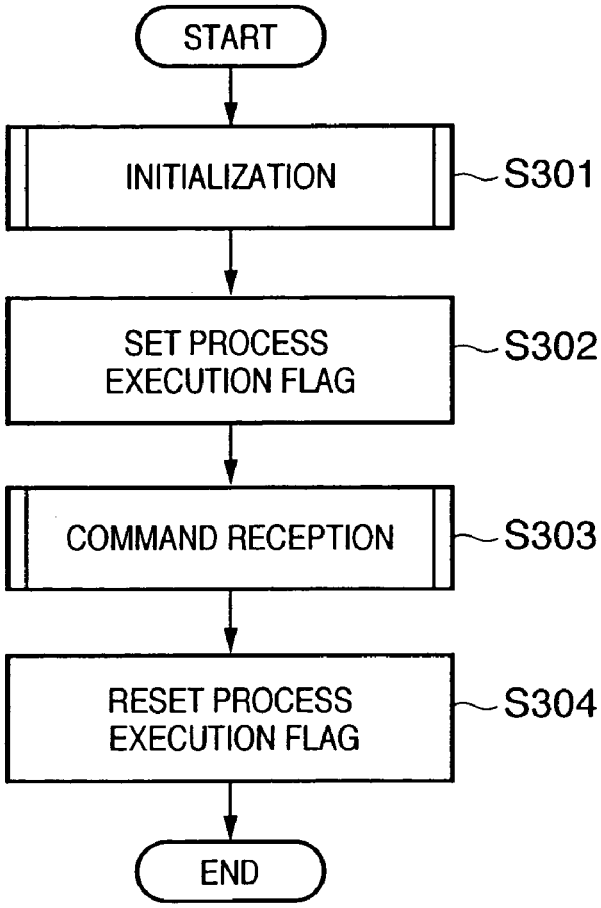
FIG. 3 is a flowchart showing a command analysis process.

When a printing start command is received from the host apparatus via the I/F E1 section and stored in the reception buffer E2, the task of a command analysis process starts. FIG. 3 is a flowchart showing the command analysis process.

In the command analysis process, various parameters are initialized first (step S301). A command analysis execution flag representing that the command analysis process is in progress is set, and the host apparatus is notified of the start of the job (step S302). Then, a command reception & analysis process starts (step S303). The command reception & analysis process is executed until a job end command is received or a job cancel message is received. After the end of the command reception & analysis process, the set command analysis execution flag is reset, and the host apparatus is notified of the end of the job (step S304).

Figure 4:
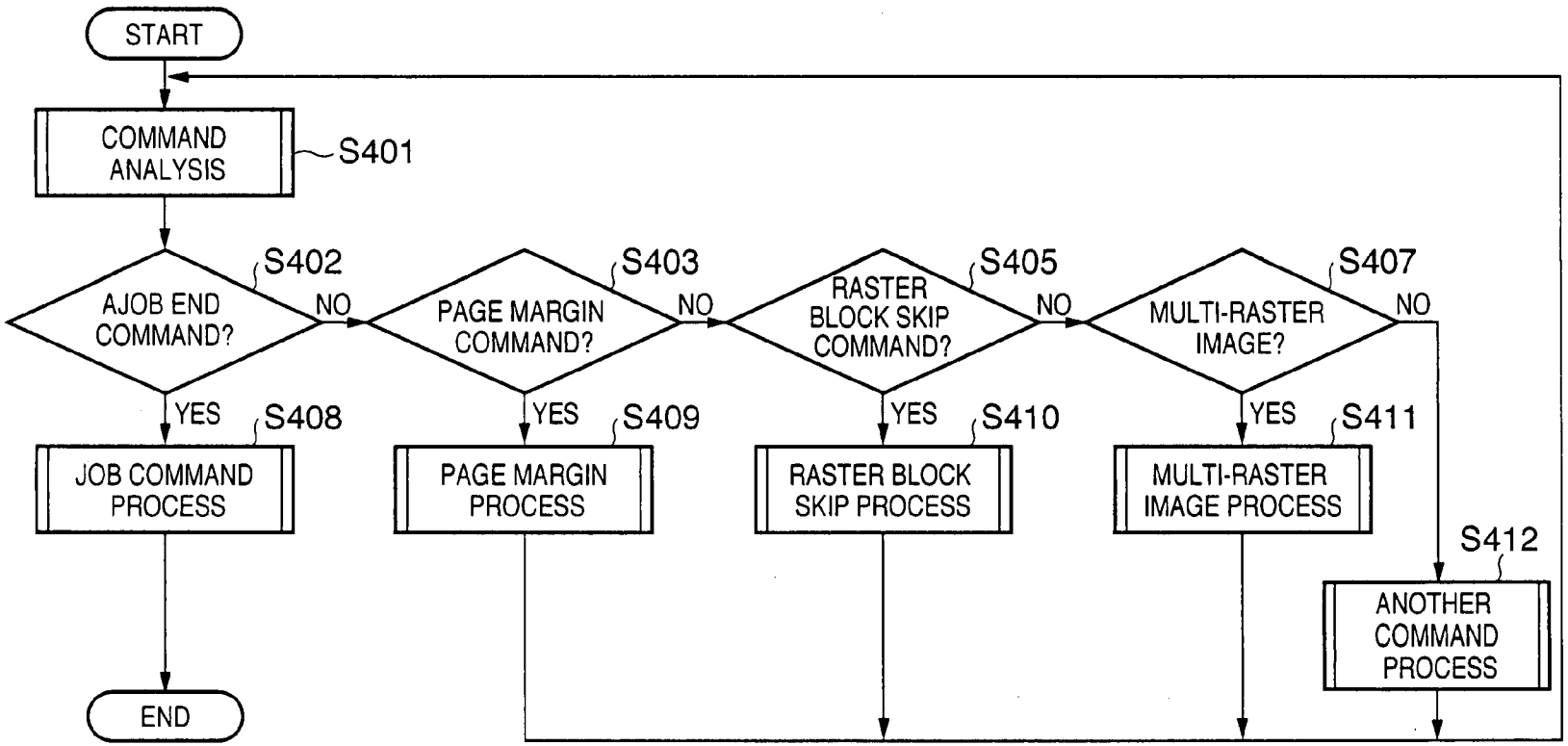
FIG. 4 is a flowchart showing a command reception & analysis process.

The command reception & analysis process in step S303 will be explained in more detail with reference to the flowchart of FIG. 4.

Data in the reception buffer E2 is analyzed for each byte (step S401). In steps S402 to S407, it is determined whether the received command is one of corresponding commands. If YES in one of steps S402 to S405, a command dispatch process is performed.

More specifically, it is determined in step S402 whether the received command is a job end command (job_end), and if YES, the process advances to step S408 to execute a job end process. In step S403, it is determined whether the received command is a page margin command (page_margin), and if YES, the process advances to step S409 to execute a page margin setting process. In step S405, it is determined whether the received command is a raster block skip command (raster_block_skip), and if YES, the process advances to step S410 to execute a raster block skip process. In step S407, it is determined whether the received command is multi-raster data (multi_raster_image), and if YES, the process advances to step S411 to execute a multi-raster data process.

Multi-raster data as an embodiment of the raster block will be explained. General raster data has at its start a header representing the contents of raster data of each raster. To the contrary, multi-raster data has at its start a header representing the contents of data of, e.g., 16 rasters contained in a raster block, and the header is accompanied with data of 16 rasters. A code representing a delimiter is inserted between one raster and the next raster. The number of rasters contained in one multi-raster data, i.e., the number of raster blocks is not limited to 16, and may be, e.g., 8 or 32.

Command processes except the above-mentioned ones are executed as other processes including an error process in step S412, and a detailed description thereof will be omitted.

Processes executed in steps S409 to S411 will be explained in more detail with reference to FIGS. 5 to 7.

Figure 5:
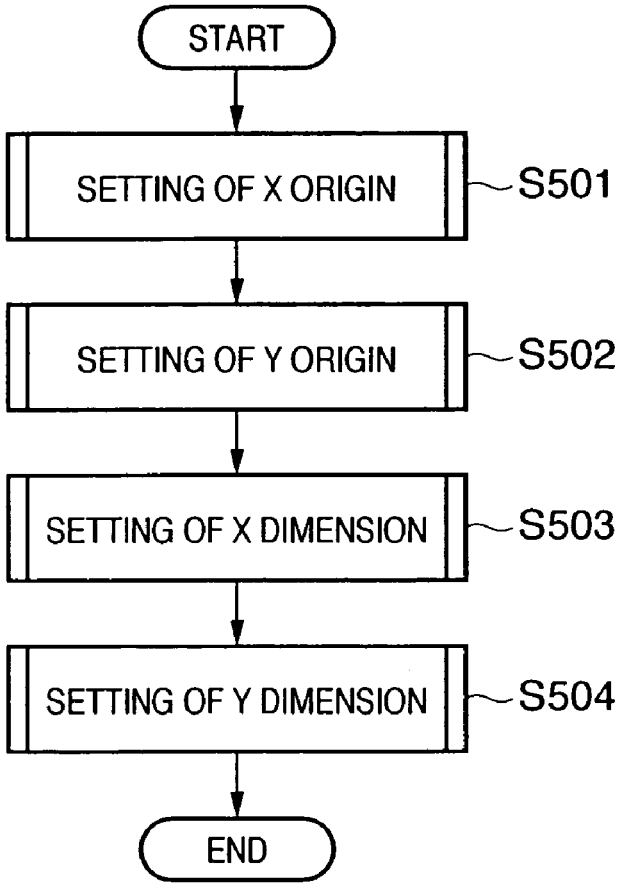
FIG. 5 is a flowchart showing details of a page margin setting process.

FIG. 5 is a flowchart showing details of the page margin setting process executed in step S409. In this process, size information of the image data 113 shown in FIG. 11 that is generated by the printer driver is read out from the reception buffer E2, and set in a corresponding global variable. More specifically, the origin in the x direction serving as the scanning direction of the printhead is set in a variable print_data_x0 in step S501. In step S502, the origin in the y direction serving as the printing medium feed direction is set in a variable print data_y0. In step S503, the length dw in the x direction is set in a variable print_data_width. In step S504, the length dh in the y direction is set in a variable print_data_length.

Figure 6:
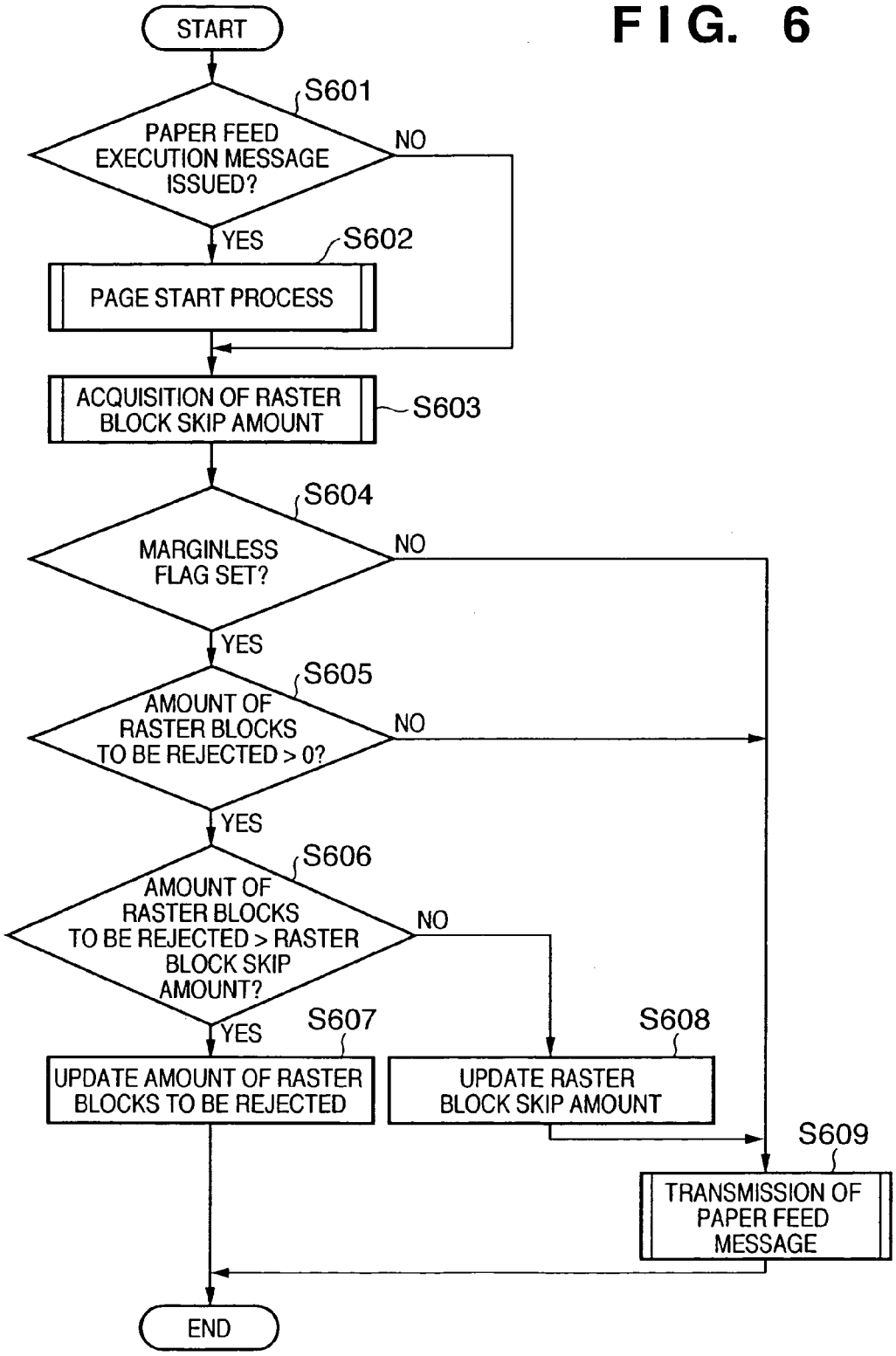
FIG. 6 is a flowchart showing details of a raster block skip process.

FIG. 6 is a flowchart showing details of the raster block skip process executed in step S410. In step S601, whether a paper feed execution message has already been issued is determined on the basis of whether a flag flag_sendmesLoad has been set. If no paper feed execution message has been issued, a page start process in step S602 is executed, and the process advances to step S603. If the paper feed execution message has been issued, the process advances to step S603 without executing step S602. The page start process in step S602 is a process of determining whether to perform marginless printing from the size of image data and that of the printing medium which are obtained by the page margin setting process described with reference to FIG. 5, and determining whether to perform an image data rejection (removing) process from the target printing area and the size of image data. Details of the page start process will be described later. In the embodiment, the centers of image data and the printing medium are adjusted to each other, and image data protrudes from the printing medium equally at the upper and lower edges and the right and left edges.

In step S603, the raster block skip amount is acquired and stored in a variable raster_block_skip representing the raster block skip amount. In step S604, it is determined whether the marginless flag (flag_over_edge) has been set in step S602, and if NO, the process advances to step S609. If the marginless flag has been set, the process advances to step S605 to determine, on the basis of the difference in length in the y direction between the target printing area of the printer and the size of image data, whether the amount of raster blocks to be rejected or removed (raster blocks not used for printing) (reject_raster_block, raster_block without using for printing) serving as a variable representing the number of raster blocks to be rejected or removed is larger than 0 (sign is positive or negative). If the amount of raster blocks to be rejected (removed) is positive, the process advances to step S609; if the amount of raster blocks to be rejected (removed) is negative, the process advances to step S606.

In step S606, it is determined whether the amount of raster blocks to be rejected is larger than the raster block skip amount acquired in step S603. If the amount of raster blocks to be rejected is larger than the raster block skip amount, the process advances to step S607 to update the value of the amount of raster blocks to be rejected to a value calculated by subtracting the raster block skip amount from the amount of raster blocks to be rejected. If the amount of raster blocks to be rejected is equal to or smaller than the raster block skip amount, the process advances to step S608 to update the value of the raster block skip amount to a value calculated by subtracting the amount of raster blocks to be rejected from the raster block skip amount, and then advances to step S609. In step S609, a paper feed message to feed a printing medium by a distance corresponding to the raster block skip amount is transmitted. In this case, an instruction is sent to the motor driver E6 to convey a printing medium, details of which will be omitted.

Figure 7:
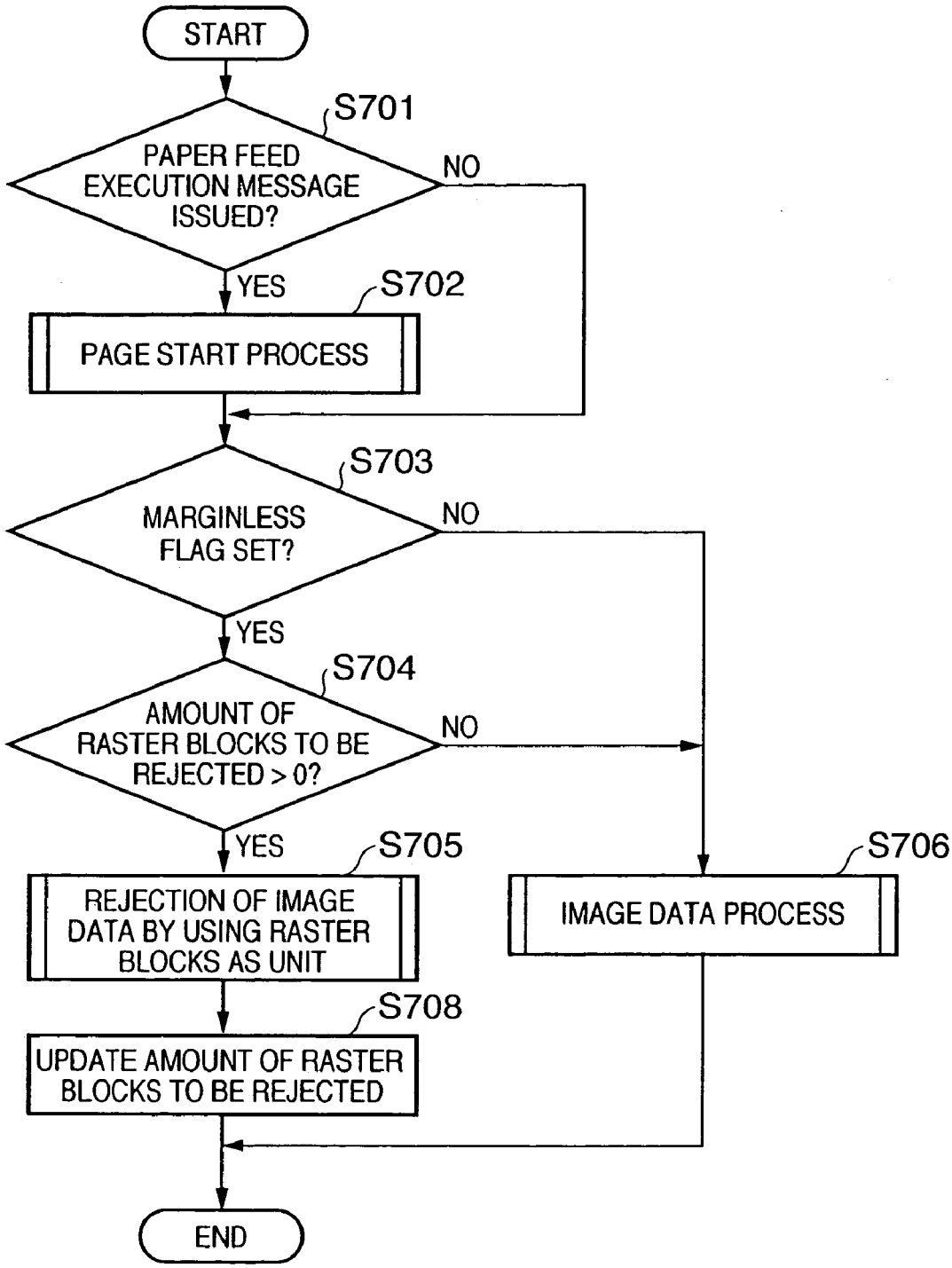
FIG. 7 is a flowchart showing details of a multi-raster data process.

FIG. 7 is a flowchart showing details of the multi-raster data process executed in step S411. In step S701, whether a paper feed execution message has already been issued is determined on the basis of whether a flag flag_sendmesLoad has been set. If no paper feed execution message has been issued, a page start process in step S702 is executed, and the process advances to step S703. If the paper feed execution message has been issued, the process advances to step S703 without executing step S702. The page start process in step S702 is the same process as that in step S602.

In step S703, it is determined whether the marginless flag (flag_over_edge) has been set in step S702, and if NO, the process advances to step S706. If the marginless flag has been set, the process advances to step S704 to determine, on the basis of the difference in length in the y direction between the target printing area of the printer and the size of image data, whether the amount of raster blocks to be rejected (reject_raster_block) serving as a variable representing the number of raster blocks to be rejected is larger than 0 (sign is positive or negative). If the amount of raster blocks to be rejected is positive, the process advances to step S705; if the amount of raster blocks to be rejected is negative, the process advances to step S706.

In step S705, image data of each raster block is rejected (removed) from the reception buffer E2 (more specifically, the reception buffer E2 is accessed, but no raster block to be rejected is read out. Alternatively, even if data of all raster blocks are read out, but a raster block to be rejected does not undergo a subsequent process.) After that, the process advances to step S708 to subtract the number of rasters contained in the rejected raster block from the amount of raster blocks to be rejected and update the amount of raster blocks to be rejected. In step S706, an image data process of converting (horizontal/vertical conversion or H/V conversion) image data into a data format corresponding to scanning of the printhead is executed. In this manner, a desired number of raster blocks are rejected, and image data is processed.

Figure 12:
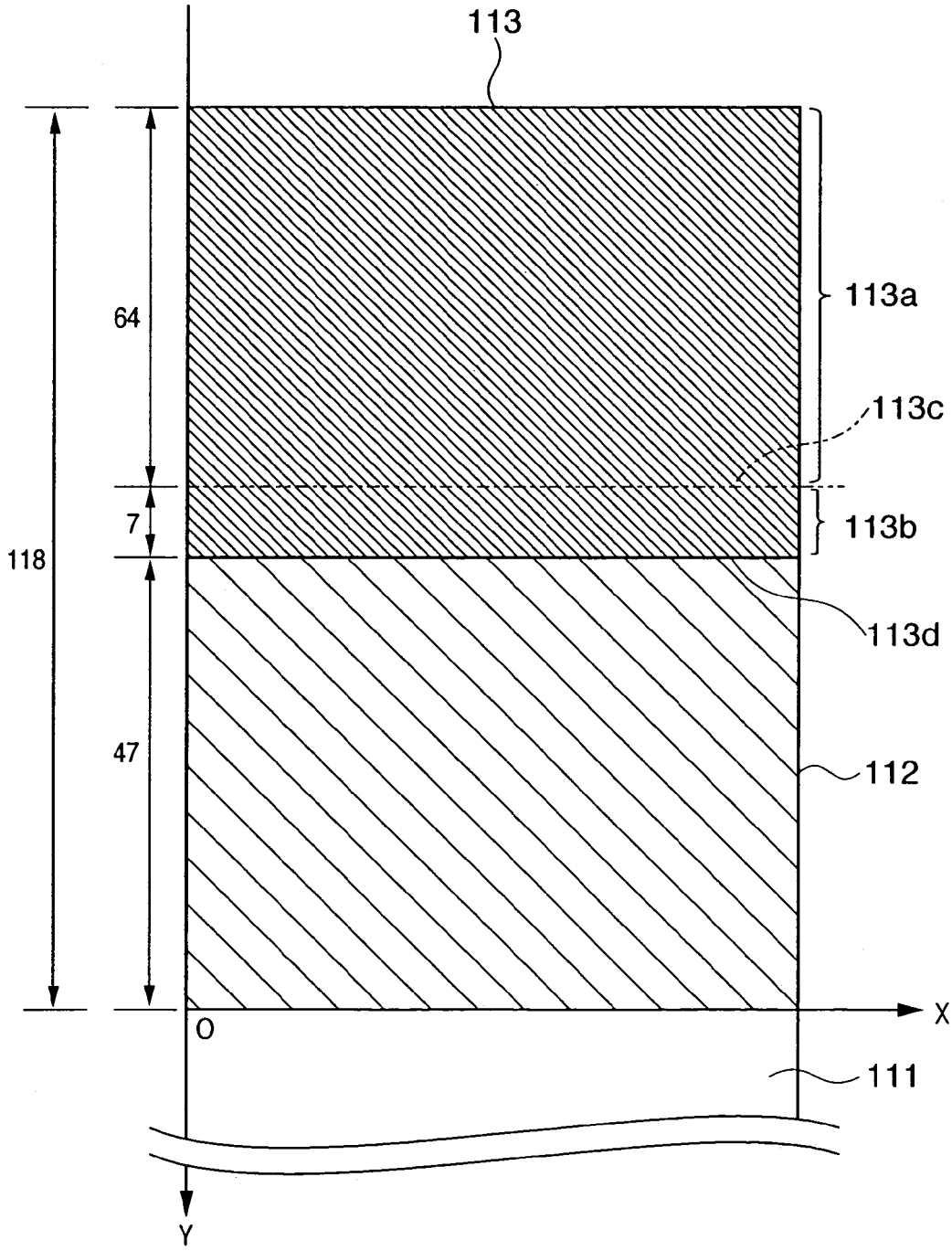
FIG. 12 is a view for explaining a concrete example of a data rejecting or removing process.

For example, FIG. 12 shows a concrete example of the amount to be rejected in marginless printing. In FIG. 12, reference numeral 111 denotes a printing medium; 112, a target printing area; and 113, image data. Each figure on the left side represents the number of rasters contained in each area. As the specification of the target printing area 112, e.g., the distance between a line 113*d* and the printing medium suffices to be 1.9 to 2.1 mm.

Figure 13A:
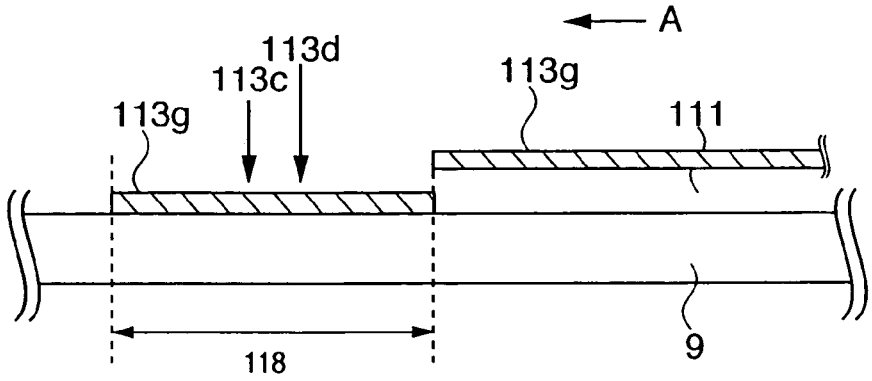
FIGS. 13A to 13C are views for explaining the concrete example of the data rejecting or removing process.
Figure 13B:
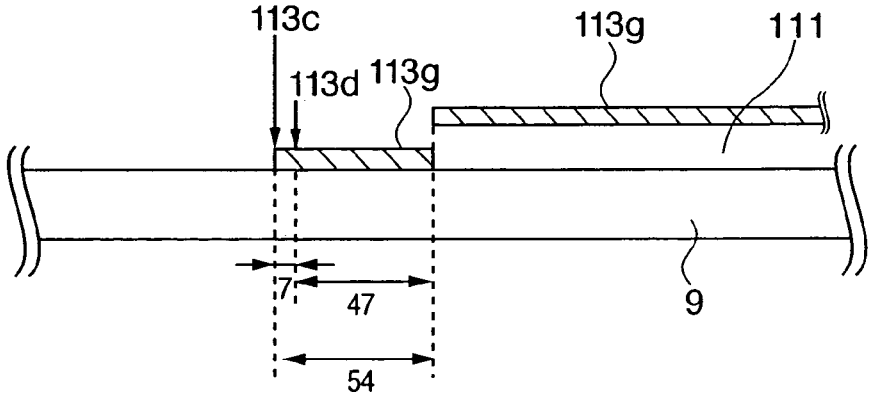
Figure 13C:
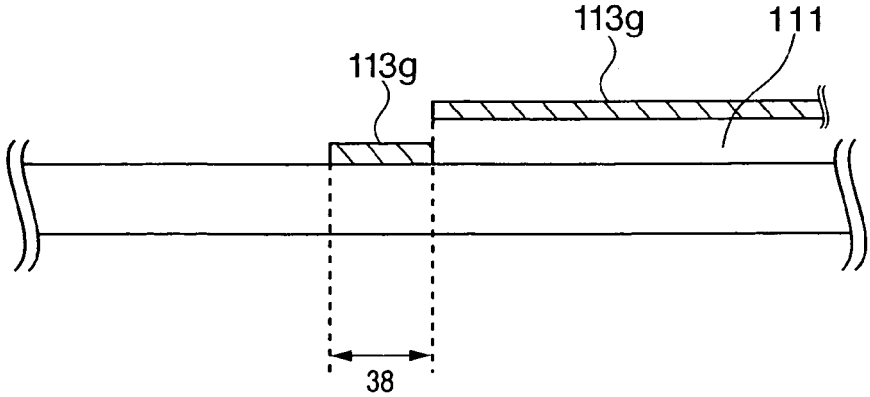

This state will be explained with reference to FIGS. 12 and 13A to 13C. In FIGS. 13A to 13C, reference numeral 9 denotes a platen; 111, a printing medium; and 113*g*, an image which is printed with ink on the basis of the image data 113. An arrow A indicates a printing medium conveyance direction.

FIG. 13A is a view based on the assumption that the image data 113 is not rejected and printing is done on the basis of all the image data. The image 113*g* of 118 rasters is printed on the printing medium 111 and also on the downstream side in the conveyance direction outside the printing medium, wastefully consuming ink.

To prevent this, as shown in FIG. 13B, part (64 rasters) of the image data 113 is so rejected as to print the image 113*g* of 54 rasters on the downstream side in the conveyance direction outside the printing medium. That is, a part not used for printing is rejected in the conveyance direction, and no printing is done on the basis of the rejected part to prevent wasteful consumption of ink.

In the example shown in FIG. 12, the protruding amount of the image data 113 from the printing medium 111 is 5 mm, and up to 2 mm (adjacent to the downstream side in the printing medium conveyance direction) outside the printing medium is the target printing area 112. Hence, data for 3 mm adjacent to the target printing area 112 is rejected from the image data 113. The 2-mm area is a margin for preventing generation of a blank at the edge even if the printing medium is conveyed with skew.

For a resolution of 600 dpi, 5 mm corresponds to 118 rasters, and 2 mm corresponds to 47 rasters. The number of rasters of a part to be rejected (data to be removed) (113) is 71. The multi-raster unit (the number of rasters contained in the raster block) is 16 rasters, and 64-raster data 113*a* corresponding to four multi-rasters (four raster blocks) is rejected (a raster block including a raster corresponding to the position of the boundary 113*d* is not rejected). The remaining 7-raster data 113*b* (71–64) and the 47-raster image data 112 are printed outside the printing medium (on the downstream side in the printing medium conveyance direction). A position 113*c* separated by 54 rasters from the origin along the y-axis is defined as a printing start position (printing start position in the conveyance direction).

In this case, after the printing medium is fed to a desired paper feed position (conveyance position), printing operation starts by scanning the printhead. In printing by initial scanning, data of 54 rasters (from the first raster to the 54th raster) from the start of printing data remaining after a rejection process are printed outside the printing medium (upper side of the printing medium (downstream side in the conveyance direction)), and data are printed from the 55th raster on the printing medium.

The platen opening 10 is formed in the region including the regions 112 and 113*b* for the platen. Even if printing is done outside the printing medium, as shown in FIG. 13B, the printing medium (or platen) is not made dirty by ink.

Figure 8:
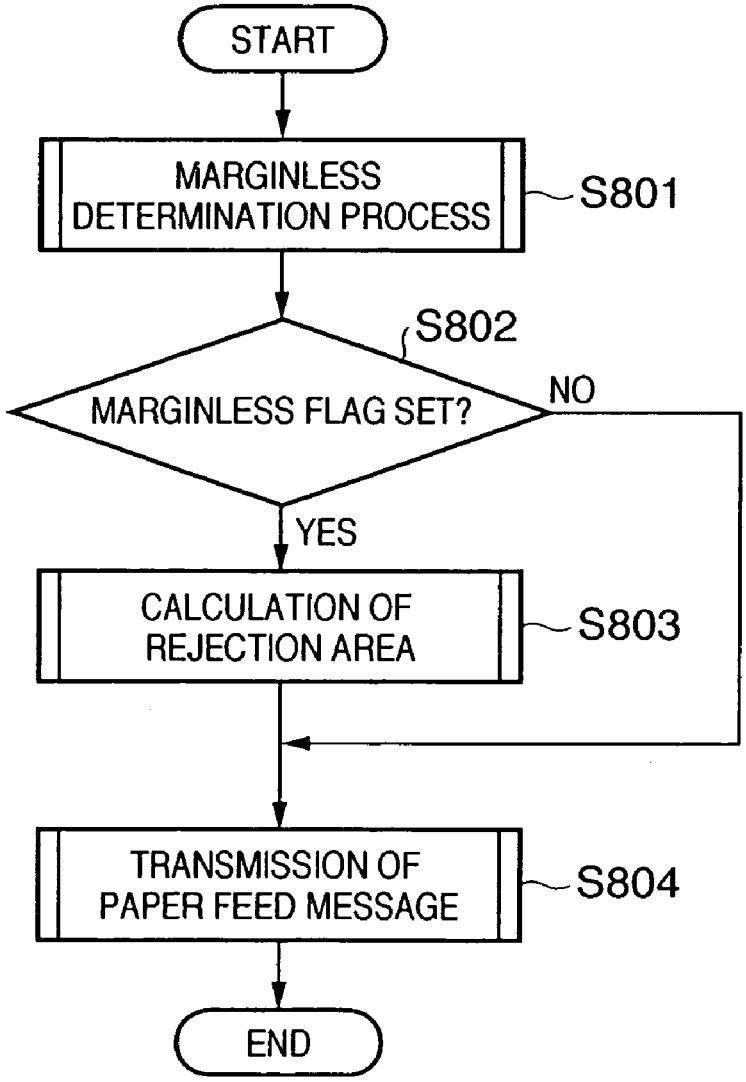
FIG. 8 is a flowchart showing a page start process.

The page start process executed in steps S602 and S702 will be explained in detail with reference to the flowchart of FIG. 8. In step S801, if the size of image data is determined to be larger than that of a printing medium in a marginless determination process (to be described later) on the basis of the size of the image data and that of the printing medium which are obtained by the page margin setting process, marginless printing is determined. If marginless printing is determined, the marginless flag (flag_over_edge) is set.

In step S802, it is determined whether the marginless flag has been set. If the marginless flag has been set, the process advances to step S803 to calculate the area of data to be rejected, and then to step S804. If no marginless flag is determined in step S802 to have been set, the process directly advances to step S804. In step S804, a paper feed message is transmitted. In response to this message, a paper sheet is fed, and the start position of the paper sheet is aligned by an amount designated by the parameter of the message.

Figure 9:
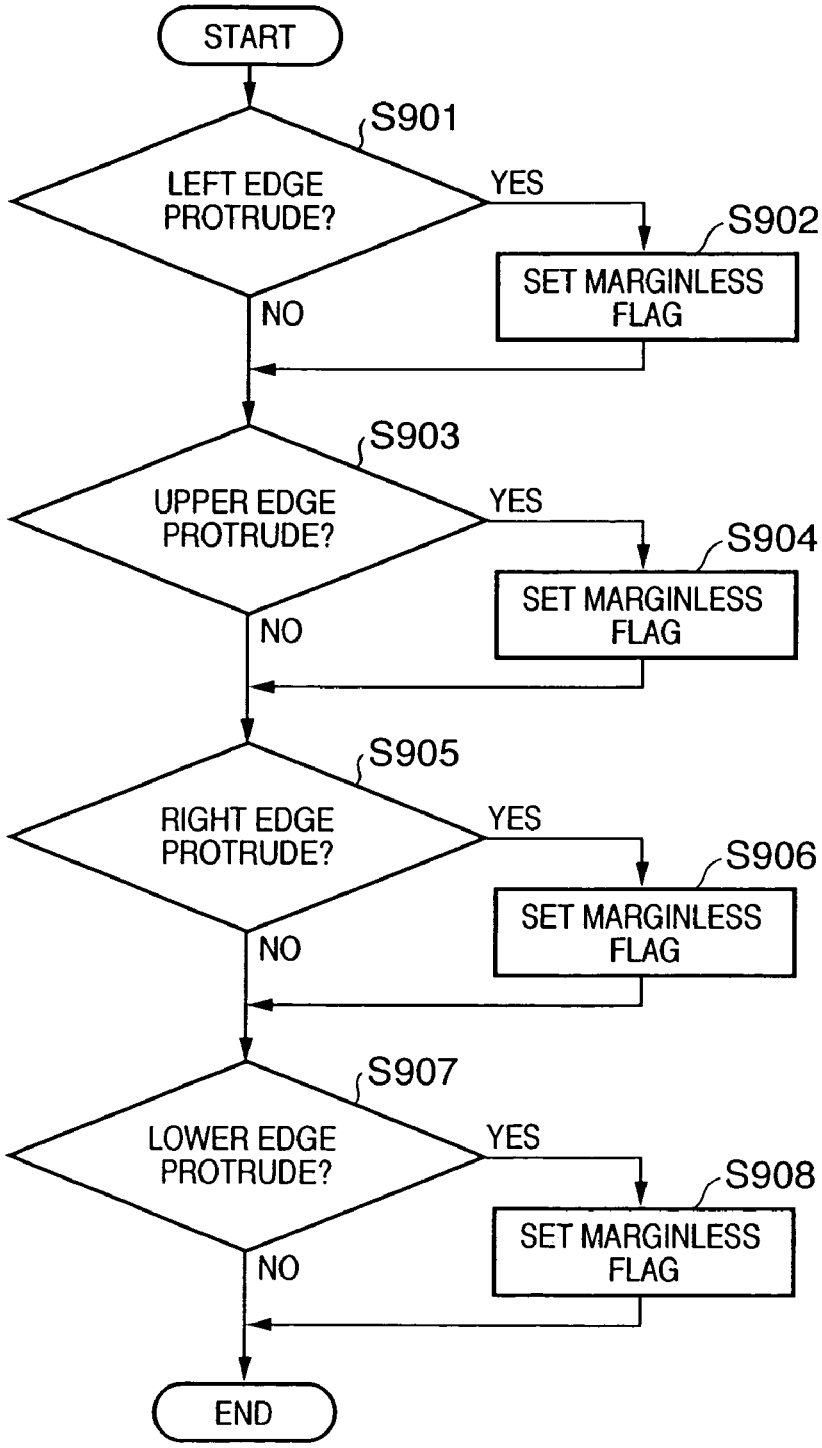
FIG. 9 is a flowchart for explaining in detail a marginless determination process.

FIG. 9 is a flowchart for explaining in detail the marginless determination process executed in step S801. As described above, when the size of image data is larger than that of a printing medium on the basis of the size of the image data and that of the printing medium which are obtained by the page margin setting process, marginless printing is determined. The positions (coordinates) of four, upper, lower, right, and left edges of image data and those of the printing medium are compared, and when the image data protrudes from the printing medium at any edge, the marginless flag (flag_over_edge) is set.

More specifically, it is determined in step S901 whether the left edge of image data protrudes from that of a printing medium. In step S903, it is determined whether the upper edge of the image data protrudes from that of the printing medium. In step S905, it is determined whether the right edge of the image data protrudes from that of the printing medium. In step S907, it is determined whether the lower edge of the image data protrudes from that of the printing medium. If the image data is determined in any one of steps S901, S903, S905, and S907 to protrude from the printing medium, the marginless flag (flag_over_edge) is set in a corresponding one of steps S902, S904, S906, and S908.

Figure 10:
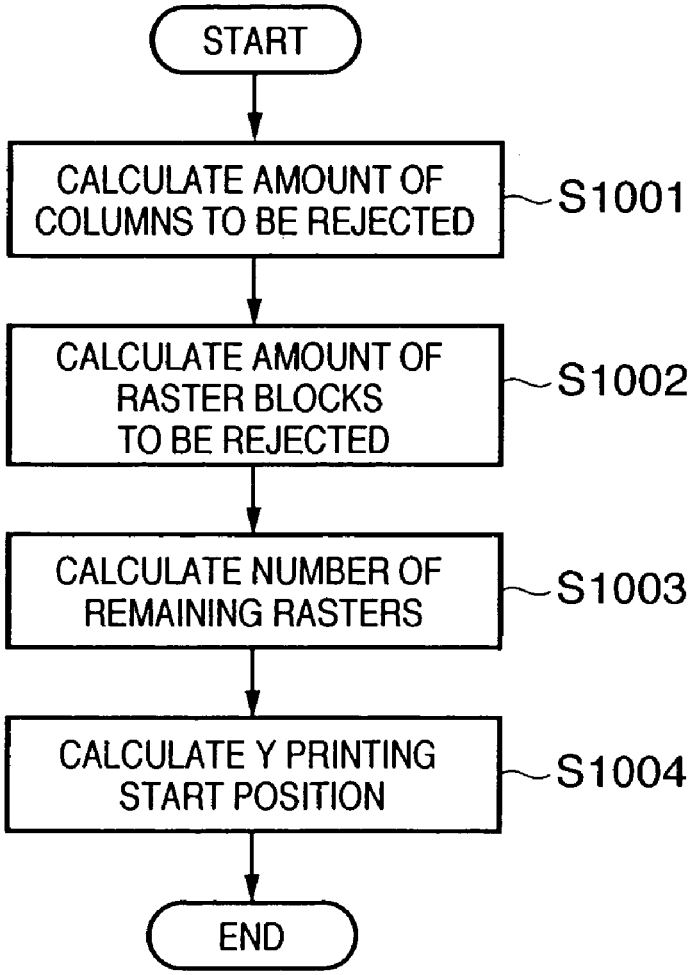
FIG. 10 is a flowchart showing in detail a data rejection (removing) area calculation process.

FIG. 10 is a flowchart showing in detail the data rejection area calculation process executed in step S803. In this process, the number of raster blocks to be rejected and the number of rasters on the upper side of the printing medium (paper feeding side or the leading edge side at which printing starts) are calculated.

In step S1001, the amount by which image data protrudes from the left edge of the target printing area is calculated as the number of columns to be rejected. In step S1002, the difference between the target printing area and the position of the upper edge of the image data is divided by the length of the raster block in the feed direction to obtain the number (reject_raster_block) of raster blocks to be rejected. This value is an integer. In step S1003, the number (reject_raster) of rasters remaining after the division in step Si 002 is obtained. In step S1004, a distance corresponding to the number (reject_raster) of remaining rasters is subtracted from the loading amount (load_start_point) of paper feed to update the loading amount. As a result, the printing start position in the feed direction is subtracted by the number of rasters remaining after the data rejecting process or the data removing process.

As described above, according to this embodiment, when image data is larger than the target printing area of the printer, deviation of the number of excess rasters can be corrected which are a protruding part of image data from the upper edge (printing start position) of a printing medium and are not rejected by a rejecting process for each raster block. The start position of marginless printing in the paper feed direction can be accurately controlled.

As described above, according to the embodiment, when image data is larger than the target printing area of the printer, deviation of the number of excess rasters can be corrected which are a protruding part of image data from the upper edge (printing start position) of a printing medium and are not rejected by a rejecting process for each raster block. The start position of marginless printing in the paper feed direction can be accurately controlled.

Other Embodiment

In the above-described data process, when the margin necessary to prevent any failure in marginless printing is 2 mm, data is printed outside the printing medium by an amount larger than the 2-mm margin (a raster block including a raster corresponding to the position of the boundary 113*d* is not rejected). However, the present invention is not limited to this method.

For example, as shown in FIG. 13C, a process may be performed in which data is printed outside the printing medium by an amount smaller than the 2-mm margin. In this process, image data of a raster block including a raster corresponding to the position of the boundary 113*d* is rejected (data of 80 rasters are rejected, and image data of 38 rasters are printed outside the printing medium).

The above rejecting process is executed for data stored in the reception buffer, but is not limited to this, and may be done for an access process for data stored in the work buffer.

The form of the printing apparatus is not limited to an apparatus which receives image data from a host apparatus, and may be an apparatus which comprises an interface for accessing a storage medium such as a memory card and reads out data from the memory card without the mediacy of any host apparatus.

The form of the printing apparatus is not limited to a serial-type printer, and may be a printer using a full-linetype printhead which has a length corresponding to the maximum printing width of a printing medium printable by a printer.

The present invention can be applied to a system comprising a plurality of devices or to an apparatus comprising a single device.

Furthermore, the invention can be implemented by supplying a software program, which implements the functions of the foregoing embodiments (program corresponding to the flowcharts shown in FIGS. 3 to 10), directly or indirectly to a system or apparatus, reading the supplied program code with a computer of the system or apparatus, and then executing the program code. In this case, so long as the system or apparatus has the functions of the program, the mode of implementation need not rely upon a program.

Accordingly, since the functions of the present invention are implemented by computer, the program code installed in the computer also implements the present invention. In other words, the claims of the present invention also cover a computer program for the purpose of implementing the functions of the present invention.

In this case, so long as the system or apparatus has the functions of the program, the program may be executed in any form, such as an object code, a program executed by an interpreter, or scrip data supplied to an operating system.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2004-106362, filed on Mar. 31, 2004, which is hereby incorporated by reference.

What is claimed is:

1. A printing apparatus which prints by scanning a carriage, on a printing medium in a direction crossing an array direction of printing elements, the carriage supporting a printhead having the printing elements arrayed in a predetermined direction, comprising:

sheet feed means for feeding the printing medium to a paper feed position in the printing apparatus;

a reception buffer which stores a control command and image data formed from a plurality of rasters as a unit that are received from a connected host apparatus;

determination means for determining, on the basis of information on a size of image data and information on a size of a printing medium that are contained in the control command, whether to perform marginless printing, which performs printing on an entire surface of the printing medium, which is smaller than a target printing area;

calculation means for calculating an amount of unnecessary image data based on a number of the plurality of rasters, a predetermined length of the target printing area in a conveyance direction and a length of the image data in the conveyance direction when marginless printing is performed;

conversion means for executing a horizontal/vertical conversion of the image data;

data rejection means for rejecting, from data to be converted by said conversion means, the unnecessary image data; and alignment means for aligning the paper feed position using the sheet feed means based on the length of the image data, the amount of the unnecessary image data, and the predetermined length of the target printing area, wherein the alignment means aligns the paper feed position based on a difference between a number of rasters of the length of the image data, and a sum of a number of rasters of the unnecessary image data and a number of rasters of the predetermined length of the target printing area.

2. The apparatus according to claim 1, wherein when the size of the image data is larger than the target printing area of the printing apparatus, said calculation means calculates an amount of unnecessary image data by using the plurality of rasters as a unit on the basis of the length of the printing medium in the conveyance direction and the predetermined length of the target printing area in the conveyance direction.

3. The apparatus according to claim 1, wherein the printhead includes an inkjet printhead which prints by discharging ink.

4. A printing start position alignment method for a printing apparatus which feeds the printing medium to a paper feed position, and prints by scanning a carriage, on the printing medium in a direction crossing an array direction of printing elements, the carriage supporting a printhead having the printing elements arrayed in a predetermined direction, comprising:

a reception step of storing in a reception buffer a control command and image data formed from a plurality of rasters as a unit that are received from a connected host apparatus;

a determination step of determining, on the basis of information on a size of image data and information on a size of a printing medium that are contained in the control command, whether to perform marginless printing on an entire surface of the printing medium, which is smaller than a target printing area;

a calculation step of calculating an amount of unnecessary image data based on a number of the plurality of rasters, a predetermined length of the target printing area in a conveyance direction and a length of the image data in the conveyance direction when marginless printing is performed;

a conversion step of executing a horizontal/vertical conversion of the image data;

a data rejection step of rejecting, from data to be converted in said conversion step, the unnecessary image data; and a start position alignment step of aligning the paper feed position based on the length of the image data, the amount of the unnecessary image data, and the predetermined length of the target printing area, wherein at said start position alignment step, the paper feed position is aligned based on a difference between a number of rasters of the length of the image data, and a sum of a number of rasters of the unnecessary image data and a number of rasters of the predetermined length of the target printing area.

5. A printing apparatus which prints by scanning a carriage, on a printing medium in a direction crossing an array direction of printing elements, the carriage supporting a printhead having the printing elements arrayed in a predetermined direction, comprising:

sheet feed means for feeding the printing medium to a paper feed position of the printing apparatus;

a reception buffer which stores a control command and image data formed from a plurality of rasters as a unit that are received from a connected host apparatus;

determination means for determining, on the basis of information on a size of image data and information on a size of a printing medium that are contained in the control command, whether to perform marginless printing, which performs printing on an entire surface of the printing medium, which is smaller than a target printing area;

calculation means for calculating an amount of unnecessary image data based on a number of the plurality of rasters, a predetermined length of the target printing area in a conveyance direction and a length of the image data in the conveyance direction when marginless printing is performed;

conversion means for executing a horizontal/vertical conversion of the image data;

data rejection means for rejecting, from data to be converted by said conversion means, the unnecessary image data; and alignment means for aligning the paper feed position using the sheet feed means based on the length of the image data, the amount of the unnecessary image data, and the predetermined length of the target printing area, wherein the calculation means calculates a data amount of the unnecessary image data by dividing a difference between a number of rasters of the length of the image data and a number of rasters of the predetermined length of the target printing area by a number of rasters as the unit.

6. The apparatus according to claim 5, wherein when the size of the image data is larger than the target printing area of the printing apparatus, said calculation means calculates an amount of unnecessary image data by using the plurality of rasters as a unit on the basis of the length of the printing medium in the conveyance direction and the predetermined length of the target printing area in the conveyance direction.

7. A printing start position alignment method for a printing apparatus which feeds the printing medium to a paper feed position, and prints by scanning a carriage, on the printing medium in a direction crossing an array direction of printing elements, the carriage supporting a printhead having the printing elements arrayed in a predetermined direction, comprising:

a reception step of storing in a reception buffer a control command and image data formed from a plurality of rasters as a unit that are received from a connected host apparatus;

a determination step of determining, on the basis of information on a size of image data and information on a size of a printing medium that are contained in the control command, whether to perform marginless printing on an entire surface of the printing medium, which is smaller than a target printing area;

a calculation step of calculating an amount of unnecessary image data based on a number of the plurality of rasters, a predetermined length of a target printing area in a conveyance direction and a length of the image data in the conveyance direction when marginless printing is performed;

a conversion step of executing a horizontal/vertical conversion of the image data;

a data rejection step of rejecting, from data to be converted by said conversion step, the unnecessary image data; and a start position alignment step of aligning the paper feed position based on the length of the image data, the amount of the unnecessary image data, and the predetermined length of the target printing area, wherein at said calculation step, a data amount of the unnecessary image data is calculated by dividing a difference between a number of rasters of the length of the image data and a number of rasters of the predetermined length of the target printing area by a number of rasters as the unit.

* * * * *